US007633408B2

(12) United States Patent
Yingst et al.

(10) Patent No.: US 7,633,408 B2
(45) Date of Patent: Dec. 15, 2009

(54) PORTABLE TRAFFIC LIGHT

(75) Inventors: John Yingst, Stevens, PA (US); David Krahulec, Manhattan, IL (US); Albert Voehringer, 216 Line Rd., Malvern, PA (US) 19355

(73) Assignee: Albert Voehringer, New York, NY (US)

( * ) Notice: Subject to any disclaimer, the term of this patent is extended or adjusted under 35 U.S.C. 154(b) by 300 days.

(21) Appl. No.: 11/709,301

(22) Filed: Feb. 21, 2007

(65) Prior Publication Data

US 2008/0198038 A1 Aug. 21, 2008

(51) Int. Cl.
*G08G 1/095* (2006.01)

(52) U.S. Cl. ..... 340/908; 340/907; 340/916

(58) Field of Classification Search ..... 340/907–924
See application file for complete search history.

(56) References Cited

U.S. PATENT DOCUMENTS 4,992,788 A * 2/1991 Arndt ..... 340/908
5,001,475 A * 3/1991 Scovin ..... 340/908
5,252,969 A * 10/1993 Kishi ..... 340/908
5,805,081 A * 9/1998 Fikacek ..... 340/908
5,986,576 A * 11/1999 Armstrong ..... 340/908
6,118,388 A * 9/2000 Morrison ..... 340/908
7,333,029 B2 * 2/2008 Hammett ..... 340/908
2001/0054970 A1 * 12/2001 Jones ..... 340/915
2004/0178928 A1 * 9/2004 Butzer et al. ..... 340/908
2005/0110660 A1 * 5/2005 Jacobs ..... 340/944
2006/0012487 A1 * 1/2006 Gibson et al. ..... 340/815.45

* cited by examiner

*Primary Examiner*—Brent Swarthout
(74) *Attorney, Agent, or Firm*—Lipton, Weinberger & Husick; Robert J. Yarbrough

(57) ABSTRACT

The Invention is a center-of-intersection portable traffic light for emergency use. The portable traffic light features a cart with wheels, a telescoping light standard and one or more light assemblies. A preemption signal detector and traffic detector detect emergency vehicles and traffic, respectively. A control system controls the operation of the portable traffic light. A radio transceiver allows the portable traffic light to communicate with the other portable traffic lights. One of the portable traffic lights in a group acts as a master and controls operation of slave portable traffic lights. Any of the portable traffic lights in a group may act as master and any may act as slave.

1 Claim, 6 Drawing Sheets

PORTABLE TRAFFIC LIGHT

A. BACKGROUND OF THE INVENTION

1. Field of the Invention

The Invention is related to the field of vehicular traffic control and particularly to portable traffic lights. The Invention is a battery-powered, center-of-intersection portable traffic light featuring a control system, radio communication among two or more of the portable traffic lights, telephone text messaging to an operator, traffic detection and preemption. Each portable traffic light of the Invention may act as either a master controlling a plurality of other portable traffic lights or as a slave being controlled by another portable traffic light of the Invention.

2. Description of the Related Art

Traffic control on roadways is essential for the efficient use of the roadways and for the prevention of traffic accidents. Traffic control in the form of a traffic light is particularly useful at intersections of two or more roadways. For purposes of this application, the term "traffic light" means an apparatus having at least one light source and capable of exhibiting at least a red and a green light to direct an operator of a motor vehicle to stop or to proceed. The use of traffic lights is well known. Colored lights to control the movement of traffic were first used in London in the nineteenth century. Red-green electrically powered traffic lights have been in use in the United States since 1912 at the latest. The first three-color traffic lights were introduced in New York and Detroit in 1920. The first manually-controlled interconnected traffic signal system was used in Salt Lake City, Utah in 1917. Automatic control of interconnected traffic lights was introduced in 1922 in Houston, Tex.

In past years, incandescent lamps were used to create white light and colored filters were used to filter out all but the desired shade of red, green or yellow. In recent years, the use of arrays of light-emitting diodes to generate light has become popular due to the substantial reduction in power consumption and the substantial increase in lamp life and hence reduction in service requirements.

In prior art stationary traffic lights, the term "preemption" refers to receiving by a traffic light of a signal from an emergency vehicle such as an ambulance or fire engine. The signal received from the emergency vehicle causes the traffic light to exhibit a green light to the emergency vehicle.

Prior art traffic lights do not teach the portable, self-contained traffic light of the Invention.

B. BRIEF DESCRIPTION OF THE INVENTION

The Invention is a portable traffic light that may be used in the center of a two-way intersection. The invention allows sophisticated traffic control to be implemented when an existing traffic control system is inoperable, for example following a natural disaster such as a hurricane.

The portable traffic light of the Invention features a towable cart supporting a light standard. Signal heads are supported by the light standard. A current embodiment of the Invention provides two signal heads for each direction of a two-way intersection, for a total of eight signal heads. Each signal head may provide three lamps corresponding to green, yellow and red. The light standard telescopes between a first and a second position. When in the first, or transport, position, the light standard is shortened, the signal heads are lowered and the portable traffic light may be transported safely behind a tow vehicle. When in the second, or deployed, position, the light standard is extended and the signal heads are raised to an appropriate height to signal drivers of motor vehicles. The portable traffic light of the invention may be battery operated for use when external electrical power is not available.

Control System

The portable traffic light of the Invention is equipped with a control system programmed to illuminate each of the lamps of the traffic light in an operator-specified timing and sequence of illumination. A plurality of portable traffic lights of the Invention may be operated as a group under common control where, for example, more than one portable traffic light is required to provide traffic control for a single intersection or for a series of intersections. To operate several portable traffic lights as a group, the control systems of the portable traffic lights communicate each to the other electronically by wire or by radio.

Master and Slave

When operated as a group, one of the portable traffic lights in the group acts as the master and the other portable traffic lights in the group act as slaves. Where the group of portable traffic lights is linked by radio, each portable traffic light is equipped with a radio transceiver to send and receive reports and instructions. Any of the portable traffic lights in a group can serve as the master and any can act as a slave. The control system of the master portable traffic light selects an appropriate sequence and timing of illumination for each lamp in each signal head of the master and each slave portable traffic light and transmits instructions to the slave portable traffic lights. The master and the slave portable traffic lights implement the instructions generated by the control system of the master portable traffic light. Each slave portable traffic light transmits reports to the master, including the status of the slave, compliance by the slave with instructions from the master and data collected by the slave.

In one current embodiment a single portable traffic light acting as master can control up to three slave portable traffic lights, with each of the slave portable traffic lights being identical to the master portable traffic light. Any number of slave portable traffic lights controlled by one master is contemplated by the invention.

Preemption

Each of the portable traffic lights, both master and slave, is equipped with a preemption receiver to receive a preemption signal transmitted by an emergency vehicle such as an ambulance. Preemption signals allow the portable traffic light to detect the approach of the emergency vehicle. Whenever a portable traffic light in a group of portable traffic lights under common control detects the preemption signal, the portable traffic light that detected the signal will transmit notice of the preemption signal to the control system of the master portable traffic light. The control system of the master portable traffic light will determine in what manner the existing timing and sequence of illumination of each lamp in each portable traffic light of the group is best preempted to move the emergency vehicle as quickly as possible through the intersections controlled by the group of portable traffic lights. The control system of the master portable traffic light also will ensure that conflicts are not allowed; that is, that intersecting lanes of traffic will not be presented with a 'green' signal at the same time. The emergency vehicle will be presented with a green signal, while traffic that might impede the emergency vehicle is presented with a red signal.

Traffic Detection

Each of the master and slave portable traffic lights is equipped with traffic detectors. Traffic detectors detect vehicles either approaching or waiting at the intersections controlled by the group of portable traffic lights. Each slave portable traffic light in a group communicates vehicle detection information to the master portable traffic light. The master portable traffic light considers the traffic information provided by the slaves and also the traffic information collected by the master portable traffic light's own traffic detectors. The control system of the master portable traffic light determines how the detected traffic can best be accommodated consistent with the programming of the master portable traffic light and transmits instructions to the slave portable traffic lights. The master and the slave portable traffic lights implement the instructions, moving the detected traffic through the controlled intersections.

Although any technology for motor vehicle detection is contemplated by the Invention, the current technology principally utilizes video detectors or microwave motion detectors. A video detector comprises a video camera and senses the presence of a vehicle moving into and out of the view of the camera. The microwave motion detector utilizes radar technology.

Programming

Each portable traffic light is equipped with a docking station communicating with the control system of the portable traffic light. An operator may manually program the control system using a removable programming module. The programming module is magnetically retained in a docking station on any one of the portable traffic lights in a group. The programming module communicates with the docking station, and hence with the control system of portable traffic light to which the interface is docked, using infrared light. Using the programming module, the operator may select the master portable traffic light to control the group and may program all of the portable traffic lights in the group at one time.

Reporting Condition Information

The master portable traffic light is equipped to provide status information to an operator at a remote location. Each portable traffic light monitors its condition, including matters such as battery charge, operation of the signal heads, conflicts, status of the electronic communication between the slave and the master portable traffic lights, and compliance by the slave portable traffic lights with the commands of the master portable traffic light. Each slave portable traffic light reports condition information of the slave portable traffic light to the master portable traffic light. The master portable traffic light monitors status information from the slaves and takes appropriate action in response to that information, consistent with the programming of the master portable traffic light. For example, the master portable traffic light may notify a remote operator that a portable traffic light in the group requires maintenance. The master portable traffic light may also take other actions as needed; for example, by commanding the group of portable traffic lights to switch to a flashing mode.

To report the status of the group of portable traffic lights to the remote operator, the master portable traffic light is equipped to use satellite or other telephonic communications technology to transmit a conventional text message. The text message is forwarded from a communications satellite over the conventional telephone network to designated telephones; for example, to the telephone of a person responsible for maintenance of a group of portable traffic lights. The text message also may be posted to a secure Internet web site for viewing by authorized persons.

Each portable traffic light also may be equipped with a global positioning system ("GPS") receiver to determine the location of the portable traffic light. If the positioning receiver indicates that the portable traffic light is more than a specified distance from a predetermined location, the control system of the portable traffic light will transmit a notice of the movement to the remote operator.

Tow Bar and Weighted Cart

The cart of each portable traffic light has a removable tow bar so that the portable traffic light may be readily towed from place to place behind a tow vehicle. The cart of the portable traffic light includes forklift pockets. The forklift pockets are configured so that the tow bar may be securely stowed in the forklift pocket to prevent theft of the tow bar.

The cart of the portable traffic light is weighted, with a substantial portion of the necessary weight provided by storage batteries. The weight selected and the distribution of that weight ensures that the portable traffic light will remain upright with the light standard in the second, or extended position, during winds of up to and including 80 miles per hour. The control system may be configured retract the light standard to the first, or transportation, position when the portable traffic light detects excessive wind speeds.

C. BRIEF DESCRIPTION OF THE DRAWINGS

D. DESCRIPTION OF AN EMBODIMENT

Figure 1:
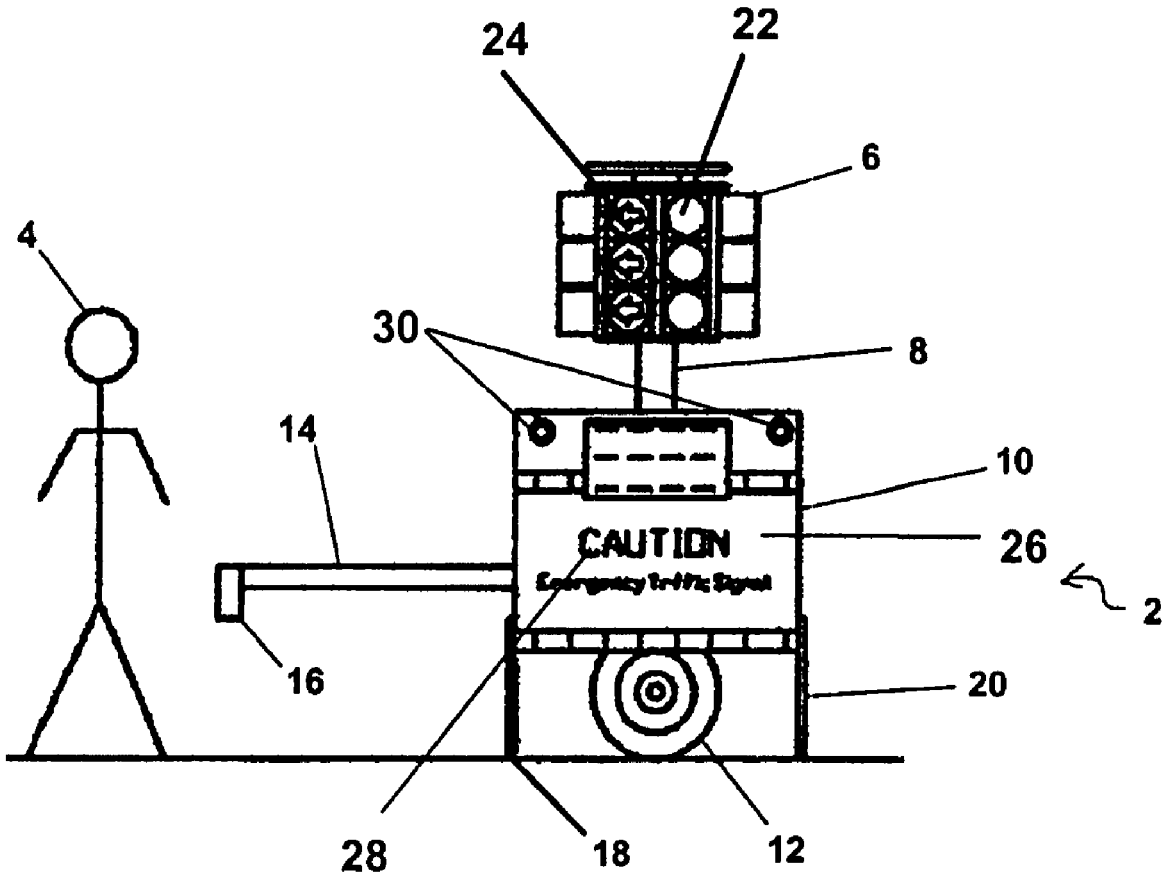
FIG. 1 is a side view of the portable traffic light of the Invention with the light standard in the retracted position.
Figure 2:
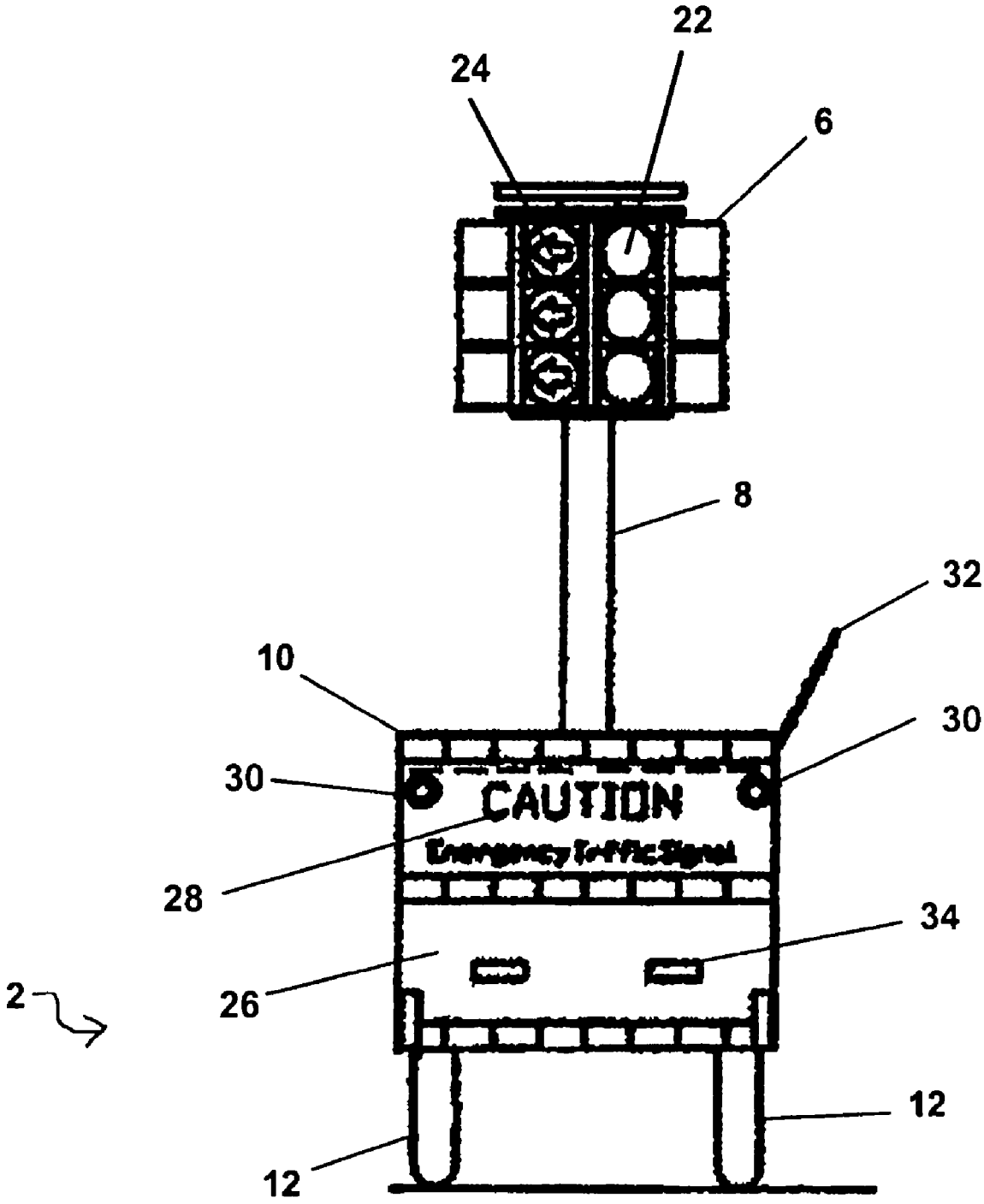
FIG. 2 is an end view of the portable traffic light of the Invention with the light standard in the deployed position.

FIG. 1 is a side view of one embodiment of the portable traffic light 2 of the Invention. A stick FIG. 4 of a six-foot tall man is shown for general size comparison. FIG. 2 is an end view of the embodiment of FIG. 1.

As shown by FIGS. 1 and 2, signal heads 6 are supported by upright light standard 8. Light standard 8 is supported by cart 10. Cart 10 features two wheels 12, which support cart 10 during transportation of cart 10. Tow bar 14 is releasably attached to cart 10. Tongue 16 appears at the end of tow bar 14 and is adapted to be attached to a trailer hitch of a tow vehicle (not shown). Conventional casters 18 supports cart 10 when tongue 16 is released from a trailer hitch and allows an operator manually to maneuver the portable traffic light 2 into a desired position.

Leveling jacks 20 are mounted to cart 10. Once the operator places the portable traffic light 2 in the desired location, the operator will deploy the leveling jacks 20, substantially transferring the weight of the portable traffic light 2 from the two wheels 12 and caster to the leveling jacks 20. Leveling jacks 20 may be conventional screw-operated leveling jacks 20.

Signal head 6 may be of any configuration required by a specific traffic control situation. Preferably, signal head 6 includes the familiar red-green-yellow signal lamps 22 and also includes red-green-yellow turn arrow lamps 24. Each lamp 22, 24 may comprise an array of light emitting diodes (LEDs). FIGS. 1 and 2 show eight signal heads 6, corresponding to four-way traffic control at an intersection of two streets.

The portable traffic light 2 may have any suitable number of signal heads 6, depending on the traffic to be controlled.

Light standard 8 has two positions: a first, or retracted, position shown by FIG. 1 and a second, or deployed, position shown by FIG. 2. In the first position, the light standard 8 presents a lower and more stable load during towing and maneuvering of the portable traffic light 2. In the deployed position, the light standard 8 is extended so that the signal heads 6 are supported at an elevation from which the signal heads 6 may be readily observed by drivers.

Cart 10 features a vertical peripheral skirt 26. Vertical peripheral skirt 26 may bear indicia 28, such as indicia 28 warning drivers to avoid a collision with the portable traffic light 2. Cart may support flashing lights, such as strobe lights 30 to alert drivers of the presence of the portable traffic light 2. Hinged door 32 provides operator access. Two fork lift pockets 34 allow the portable traffic light 2 to be easily picked up and handled by materials handling equipment. One or both fork lift pockets 34 is configured to receive and to securely store tow bar 14 when tow bar 14 is released from cart 10.

Figure 3:
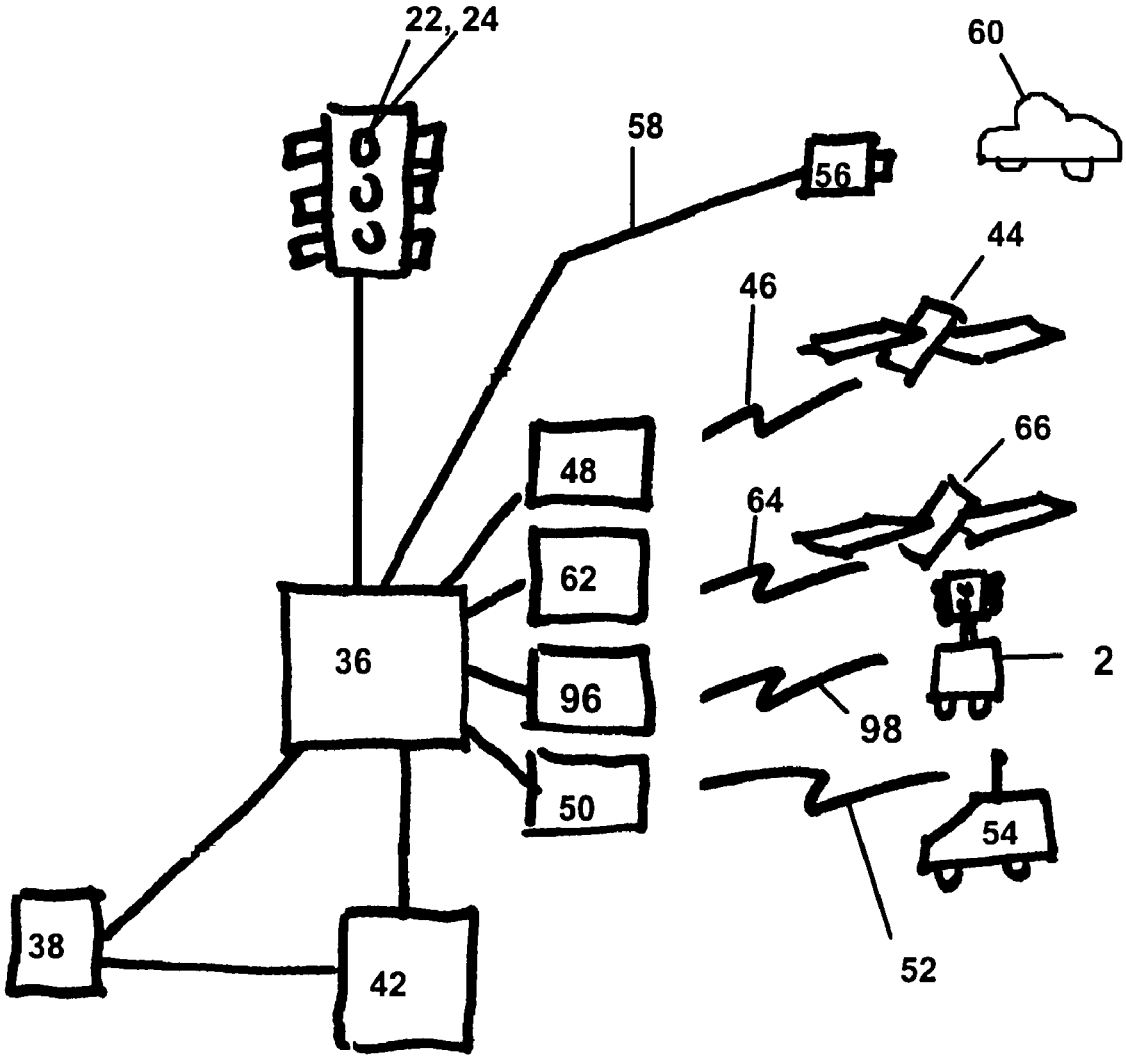
FIG. 3 is a schematic of the control system of the portable traffic light.

FIG. 3 is a schematic diagram of the control system 36 of the portable traffic light 2 and the systems controlled by the control system 36. From FIG. 3, control system 36 is programmed to control all of the systems of the portable traffic light 2. Electric motor 38 shown by FIG. 3 is housed within cart 10 and controlled by control system 36; alternatively, electric motor 38 may be controlled by a switch. Electric motor 38 moves light standard 8 between the first and second positions by any conventional means, including operating a winch and a cable, by turning a pinion gear against a rack, by operating a screw jack, by operating a hydraulic jack, by forcing compressed air into an air cylinder, or by any other means known in the art. As shown by FIG. 3, battery 42 provides electrical power for all of the systems of portable traffic light 2, including electrical power to electric motor 38 to move light standard 8 between the first and second positions, electrical power for illumination of lamps 22, 24, and electrical power for control system 36.

An array of GPS satellites 44 transmits GPS signals 46 that are received by a positioning receiver 48. Positioning receiver 48 processes the GPS signals 46 and determines a location of the portable traffic light 2. The positioning receiver 48 communicates the location of the portable traffic light 2 as determined by the positioning receiver 48 to the control system 36.

Portable traffic light 2 control system 36 may be equipped with a preemption receiver 50. Preemption receiver 50 transmits a signal to control system 36 when preemption receiver 50 receives a preemption signal 52 from an emergency vehicle 54. Control system 36 may be programmed to send instructions to signal head 6 to exhibit a green light in the direction of approach of emergency vehicle 54 and to exhibit a red light to traffic that might impede the movement of the emergency vehicle 54 through the intersection.

Portable traffic light 2 may be equipped with traffic detector 56, which may be a conventional video traffic detector, a conventional microwave motion traffic detector, a pressure or magnetic detector, or any other traffic detector known in the art. The traffic detector 56 generates a traffic detection signal 58 that is conveyed to the control system 36. The control system 36 is programmed to examine the traffic detection signal 58 and determine whether traffic 60 is detected. If traffic 60 is detected, the control system 36 may compare the traffic 60 detected approaching the portable traffic light 2 from one direction to the traffic 60 approaching from another direction. The control system 36 may modify the timing and sequence of illumination of the lamps 22, 24 to move the detected traffic 60 efficiently through the intersection.

If the traffic detector 56 is a video traffic detector, the traffic detection signal 58 is transmitted to the control system 36 via a hardwire interface. The portable traffic light 2 may be equipped with more than one traffic detector technology (for example, with both video and microwave technologies) to best serve the circumstances in which the portable traffic light 2 will be used.

Figure 4:
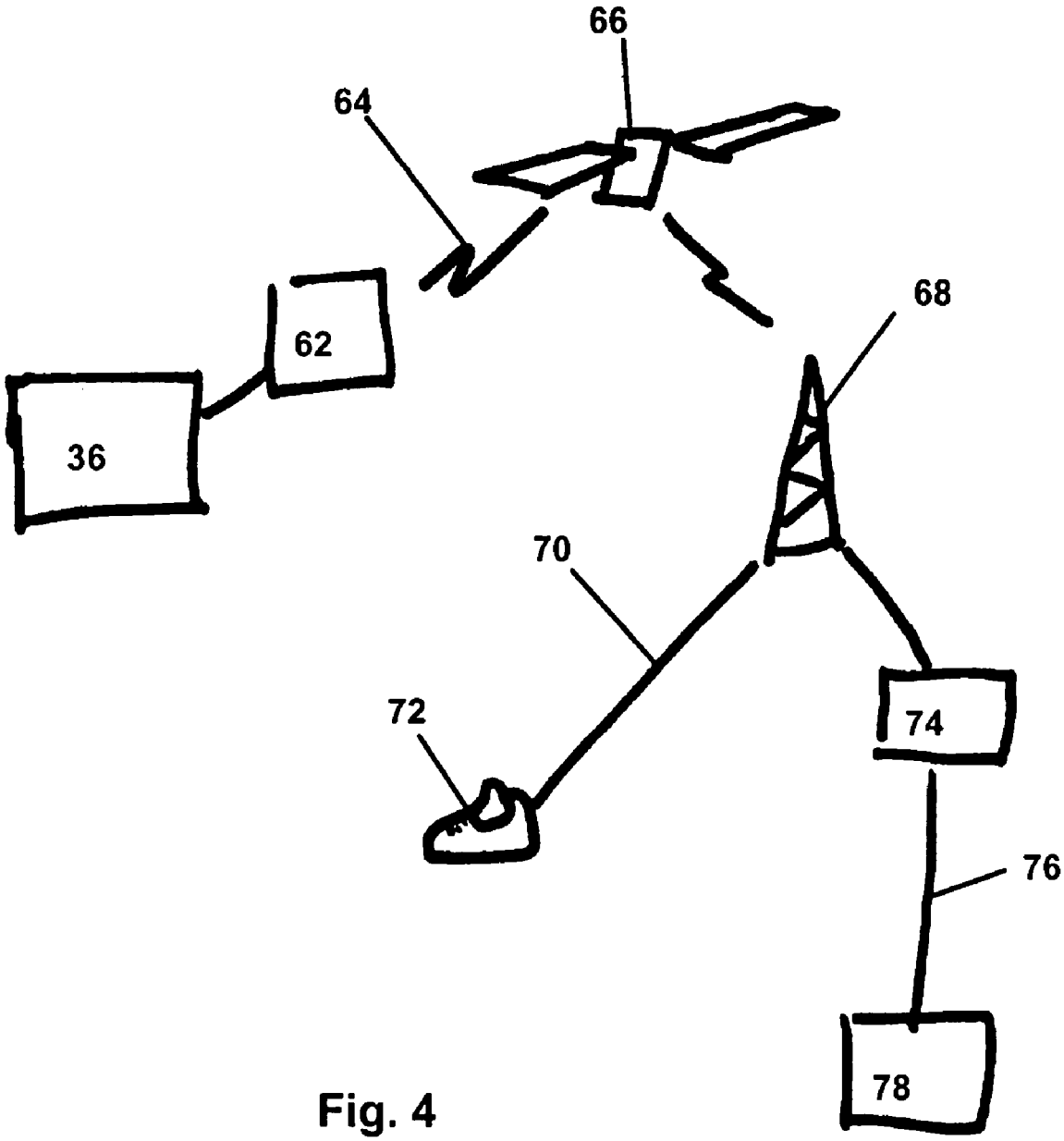
FIG. 4 is a schematic diagram of the text message reporting system of the portable traffic light.

As shown by FIGS. 3 and 4, the portable traffic light 2 of the Invention may be configured to monitor its location and operational status using conventional techniques and to report that location and status to a remote operator. The operational status may include whether the control system 36, lamps 22, 24 and light heads 6 are operating properly, the charge status of the battery 42, and any other information that an operator may find useful concerning the operation and maintenance of the portable traffic light 2. The portable traffic light 2 may be equipped with sensors (such as traffic detector 56, positioning receiver 48 and preemption receiver 50) and may report information detected by the sensors. The control system 36 may compare the actual operation of the portable traffic light 2 to the expected or commanded operation, and report any resulting conflict to the operator.

To effect communication of location and status of the portable traffic light 2 and as shown by FIGS. 3 and 4, the control system 36 is configured to communicate with a satellite radio transmitter 62 that is supported by cart 10. The satellite radio transmitter 62 is configured to communicate with a communications satellite 66 using conventional satellite telephone technology. Control system 36 is configured to generate a conventional telephone text message 64 and uses satellite radio transmitter 62 to transmit the telephonic text message 64 to a communications satellite 66. The communications satellite 66 re-transmits the text message 64 from control system 36 to a ground station 68. The text message 64 is conveyed from the ground station 68 using the conventional telephone system 70 to a telephone 72 of the remote operator. The operator may view the text message 64 using the operator's telephone 72. The text message 64 also may be transmitted by the ground station 68 and conventional telephone system 70 to a server computer 74 and stored in the memory of the server computer 74. An authorized person may access the memory of the server computer 74 using the Internet 76 and see the text message 64 display on the user's personal computer 78 or other Internet-enabled device. Use of the satellite radio transmitter 62 allows the portable traffic light 2 of the Invention to report to the remote operator from locations that have experienced an interruption in conventional land line or cellular telephone service due to a hurricane or other disaster.

Figure 5:
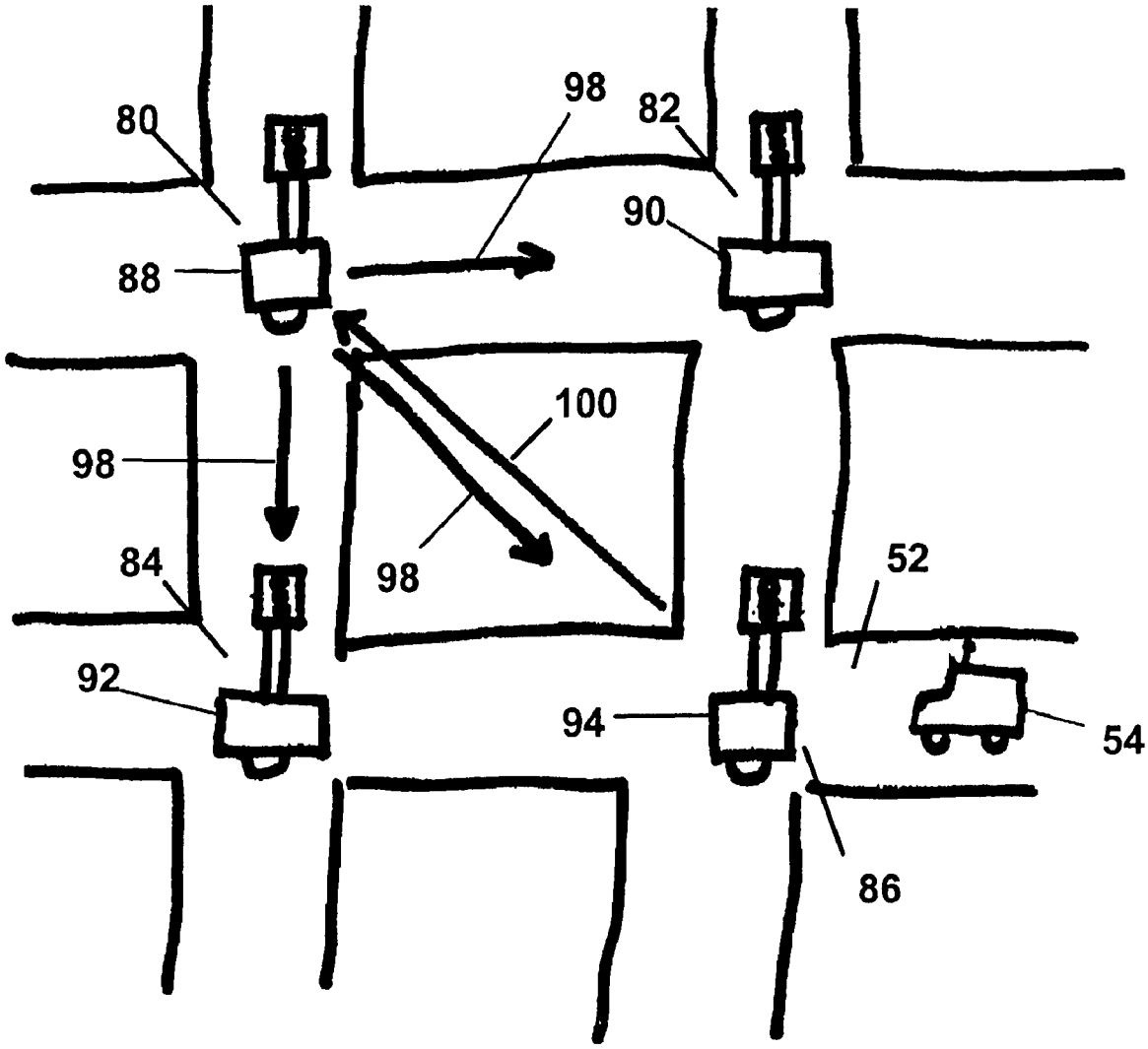
FIG. 5 is a diagram of four portable traffic lights being operated as a group.
Figure 6:
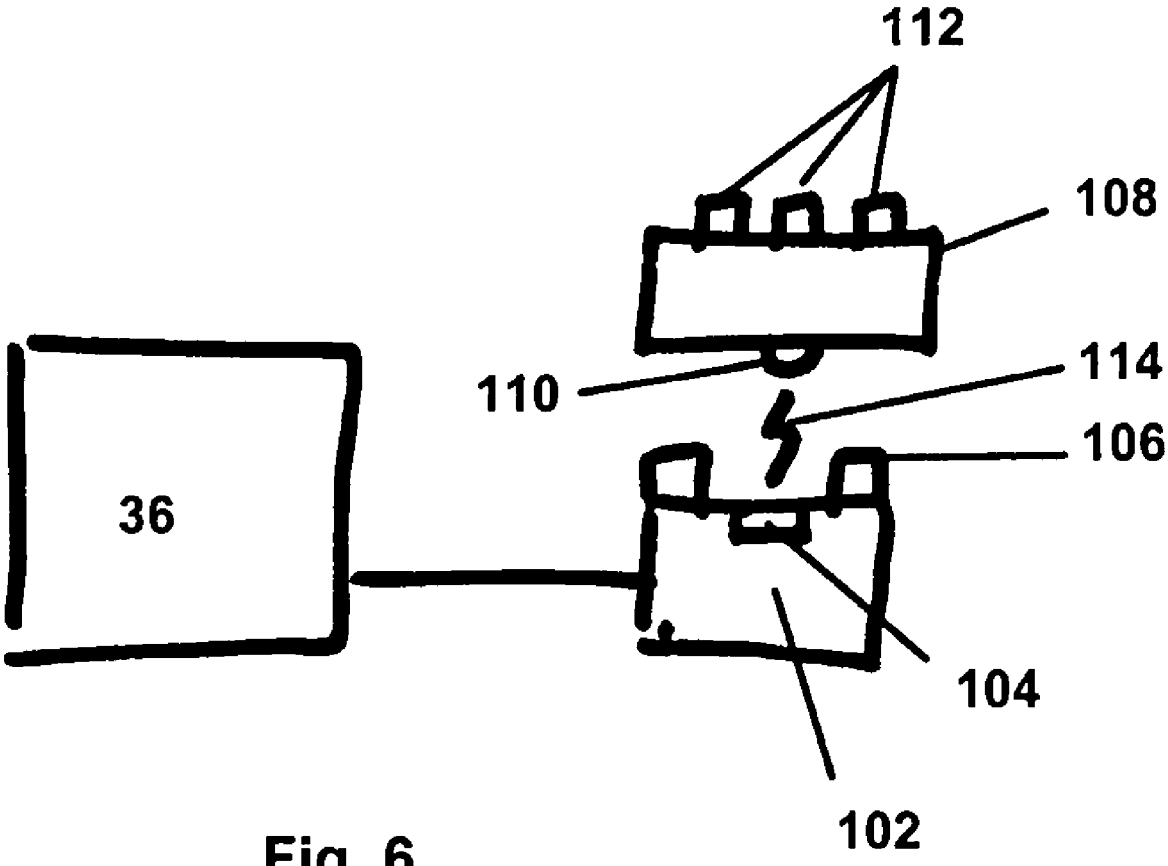
FIG. 6 is a schematic diagram of the programming system of the portable traffic light.

As shown by FIGS. 5 and 6, the portable traffic light 2 may be one of a group of portable traffic lights 2 where more than one portable traffic light 2 is required for coordinated control of traffic at an intersection or at multiple intersections. FIGS. 5 and 6 illustrate use of a coordinated group of four portable traffic lights 2 to control four adjacent intersections 80, 82, 84, 86. Where multiple portable traffic lights 2 are operated as a group, one portable traffic light 2 will act as a master 88 and the remainder of the portable traffic lights in the group will act as slaves 90, 92, 94.

The master 88 and slaves 90, 92, 94 each is equipped with a radio transceiver 96, shown by FIG. 3. The radio transceiver 96 is capable of sending or receiving communications 98 with another portable traffic light 2. The master 88 and slave 90, 92, 94 portable traffic lights are substantially identical one to another and any of the group of portable traffic lights 2 can be programmed to act as master 88 and any can be programmed to act as slave 90, 92, 94. The master 88 will transmit communications 98 that are instructions using the radio transceiver 96 to the control systems 36 of each slave 90, 92, 94, including instructions as to the timing and sequence of illumination of each lamp 6 of the slaves 90, 92, 94. The control system 36 that is a part of each slave 90, 92, 94 will receive those instructions through the radio transceiver 96 of the slave 90, 92, 94 and will obey those instructions. As used in this document and in the claims, the term "timing and sequence of illumination" means the timing and duration of illumination of a lamp 22, 24 in combination with the timing and duration of illumination of each other lamp 22, 24, including lamps 22, 24 located in a plurality of portable traffic lights 2 that are part of the same group of portable traffic lights 2.

Each slave 90, 92, 94 will transmit communications 98 to the master 88. The communications 98 by slaves 90, 92, 94 are reports relating to the operational status of each slave 90, 92, 94 and relating to compliance by each slave 90, 92, 94 with each command by master 88. Slaves 90, 92, and 94 also will report the status of communications among the portable traffic lights 2. Each slave 90, 92, 94 will report information gathered by sensors, such as traffic detectors 58, preemption detector 50 or positioning receiver 62. The master 88 will consider the information received from the slaves, along with the information collected by the master 88 relating to its own operations and sensors, and will decide on a sequence and timing of illumination for each lamp 6 of each portable traffic light 2, both master 88 and slave 90, 92, 94 of the group.

If the master 88 concludes that a conflict has occurred, the master 88 may order that each portable traffic light 2 in the group revert to a default flashing red mode to avoid the danger of accidents posed by a conflict. The master 88 also may notify the remote operator of the conflict. For use in this application and in the claims, the term "conflict" means any error in the operation of one or more portable traffic lights 2, any failure of communication among a group of portable traffic lights, or when intersecting lanes of one or more intersections are presented with a green signal at any one time.

FIG. 5 provides an example of coordinated operation of master 88 and slave 90, 92, 94 portable traffic lights 2 in the context of preemption. An emergency vehicle 54 is shown by FIG. 5 approaching an intersection 86, which is one of four 80, 82, 84, 86 controlled by group of portable traffic lights 2. Slave 94 is assigned and located to signal traffic at intersection 86. Preemption detector 50 of slave 94 receives a preemption signal 52 from emergency vehicle 54. The slave 94 transmits notice 100 of the preemption signal 52 to the master 88. The transceiver 96 of master 88 receives notice 100 of the preemption signal 52 and informs control system 36 of master 88. The control system 36 of master 88 determines how the timing and sequence of the portable traffic lights 86, 88, 90, 92 in the group, both master 88 and slave 90, 92, 94, should be changed to move the emergency vehicle 54 through the controlled intersections 80, 82, 84, 86 as quickly as possible. The master 88 then utilizes transceiver 96 to send communications 98 to each of the slaves 90, 92, 94. Each slave 90, 92, 94 receives and implements the communication 98, moving emergency vehicle 54 through the intersections 80, 82, 84, 86.

Slaves 90, 92, 94 may be programmed to transmit to master 88 information concerning operational status using radio transceivers 96. Master 88 may be programmed to transmit to the human operator information concerning system status, battery status and location using the satellite radio transmitter 62, text message 64 and communications satellite 66. Radio transceiver 96 and satellite radio transmitter 62 may be the same apparatus.

Another example of information that may be transmitted among the portable traffic lights 2 of a group and to the human operator is notice of the startup or shutdown of a portable traffic light 2, operation of the lamps 22, 24 and notice of battery 42 charge condition. Notice relating to any of these matters may inform the human operator as to the need for maintenance or other actions relating to the portable traffic light 2.

FIG. 6 illustrates the programming of a portable traffic light 2. Docking station 102 is mounted on cart 10. Docking station 102 is an input device for control system 36 and is operatively connected to control system 36 using conventional techniques. Docking station 102 features a photoelectric cell 104. Docking station 102 may feature magnets 106, which releasably secure programming module 108 to docking station 102. Magnets 106 alternatively may be mounted on programming module 108. Programming module 108 includes an infrared lamp 110 and keys 112 operating the infrared lamp 110. Magnets 106 hold infrared lamp 110 in alignment with photoelectric cell 104 when the programming module 108 is docked with the docking station 102. Infrared lamp 110 generates infrared light 114 that is detected by photoelectric cell 104.

A human operator can manipulate keys 112, thereby causing illumination of infrared light 110 in a prescribed duration and sequence. Photoelectric cell 104 detects the infrared light 110. Control system 36 interprets the transmitted information as programming instructions and responds accordingly. Because the portable traffic light 2 to which the docking station 102 is attached may communicate with other portable traffic lights through the radio transceiver 96, the human operator may program any or all of the portable traffic lights 2 in range of the radio transceiver 96 of the portable traffic light 2. The human operator thereby may program all of the portable traffic lights 2 in a group from a docking station 102 mounted on any one of the portable traffic lights 2 in the group. The human operator may assign any of the portable traffic lights 2 of the group as master 88 and may assign any of the portable able traffic lights 2 of the group as a slave 90, 92, 94.

Programming module 108 may be constructed with a microprocessor and a computer memory so that the operator enters programmed instructions into the programming module in advance and then downloads the programmed instructions through the docking station into the control system 36. Alternatively, the programming module may be configured to manually program the control system 36 as the operator presses keys 112.

In describing the above embodiments of the invention, specific terminology was selected for the sake of clarity. However, the invention is not intended to be limited to the specific terms so selected, and it is to be understood that each specific term includes all technical equivalents that operate in a similar manner to accomplish a similar purpose.

We claim:

1. A portable traffic light apparatus, the apparatus comprising:

a. a cart;

b. a plurality of wheels rotatably connected to said cart and adapted to selectably support said cart;

c. an upright light standard attached to said cart, said upright light standard being having a first and a second position, said first position being a retracted position, said second position being an extended position;

d. a light head supported by said light standard, said light head including a lamp;

e. a power supply, said power supply being connected to said cart;

f. a control system connected to and supported by said cart, said control system being operably connected to said power supply, said control system being operably connected to said lamp, said control system being programmed to control illumination of said lamp, said control system being programmable as a master capable of controlling a slave, said control system being programmable as said slave capable of being controlled by said master;

g. a radio transceiver supported by said cart and connected to said control system, said radio transceiver being configured to receive a report and to transmit an instruction when said control system is programmed as said master, said radio transceiver being configured to transmit said report and to receive said instruction when said control system is programmed as said slave;

h. said cart is a one of a plurality of said carts;

i. said upright light standard is a one of a plurality of said upright light standards;

j. said light head is a one of a plurality of said light heads;

k. said lamp is a one of a plurality of said lamps;

l. said power supply is a one of a plurality of said power supplies;

m. said control system is a one of a plurality of said control systems; and n. said radio transceiver is a one of a plurality of said radio transceivers, each other of said plurality of carts supporting in operable association another of said plurality of upright light standards, another of said plurality of light heads, another of said plurality of lamps, another of said plurality of power supplies, another of said plurality of control systems and another of said plurality of radio transceivers, each other of said plurality of control systems being configured to be selectably programmed as said master, and each other of said plurality of control systems being configured to be selectably programmed as said slave, wherein when said one of said plurality of control systems is programmed to be said master and each other of said plurality of control systems is programmed to be said slave, said master is configured to communicate with said slave to control said illumination of said lamp operably associated with said slave, the apparatus further comprising: a plurality of docking stations, each of said plurality of carts supporting a one of said plurality of docking stations in operable association with said one of said plurality of said control systems supported by said cart, each of said plurality of said docking stations being configured to receive a programming instruction from an operator and to convey said programming instruction to said control system with which said docking station is associated, said control system with which said docking station is associated being configured to transmit said programming instruction to each other of said plurality of control systems using said radio transceiver, said each other of said plurality of control systems being configured to implement said programming instruction, whereby each of said plurality of control systems may be programmed by said operator utilizing said docking station associated with any one of said plurality of control systems, the apparatus further comprising: a programming module, said programming module being configured to mate with any of said plurality of docking stations, said programming module being configured to transmit said programming instruction to said docking stations, said programming module being configured to be selectably and magnetically retained to said docking station, said programming module being configured to transmit said programming instruction to said docking station by infrared light.

* * * * *